United States Patent [19]

Solie et al.

[11] Patent Number: 4,679,851

[45] Date of Patent: Jul. 14, 1987

[54] CUSHION AND METHOD

[75] Inventors: O. B. Solie, Rockford, Ill.; Godfrey J. Pyle, Shoreview, Minn.

[73] Assignee: Minnesota Mining and Manufacturing Company, Saint Paul, Minn.

[21] Appl. No.: 761,000

[22] Filed: Jul. 31, 1985

[51] Int. Cl.[4] ..... A47C 31/02; B68G 7/05

[52] U.S. Cl. ..... 297/452; 5/472; 297/219; 297/DIG. 1; 297/DIG. 6

[58] Field of Search ..... 297/452, 219, DIG. 1, 297/DIG. 6; 5/470, 471, 472; 29/91.1, 91.5

[56] References Cited

U.S. PATENT DOCUMENTS

| | | | |
|---|---|---|---|
| 4,040,881 | 8/1977 | Wallace | 5/472 X |
| 4,454,183 | 6/1984 | Wollman | 428/92 |
| 4,534,595 | 8/1985 | Abe et al. | 297/452 |

FOREIGN PATENT DOCUMENTS

| | | | |
|---|---|---|---|
| 486612 | 7/1976 | Australia | 297/DIG. 6 |
| 2342943 | 3/1974 | Fed. Rep. of Germany | 297/219 |
| 2353489 | 5/1974 | Fed. Rep. of Germany | 297/219 |
| 2644592 | 4/1978 | Fed. Rep. of Germany | 297/452 |
| 1320876 | 2/1963 | France | 297/219 |

*Primary Examiner*—Kenneth J. Dorner
*Assistant Examiner*—Peter R. Brown
*Attorney, Agent, or Firm*—Donald M. Sell; James A. Smith; William L. Huebsch

[57] ABSTRACT

A cushion including a resiliently compressible pad having one or more openings through and disposed at about a right angle to its front surface, an enclosure assembly surrounding the pad and comprising a front cover overlaying the front surface of the pad and having a part extending into the opening, and fastener means for retaining the part of the front cover in the opening including a first hook headed fastener portion attached in the opening and a second fastener portion with loops engaged around the hook heads of said first fastener portion attached to the part of the cover in the opening.

14 Claims, 16 Drawing Figures

CUSHION AND METHOD

TECHNICAL FIELD

This invention relates to methods for making cushions of the type used on various types of furniture or as pillows, and to the structures of such cushions.

BACKGROUND ART

Cushions of the type including a resiliently compressible pad and an enclosure assembly surrounding the pad are commonly used on furniture or as pillows. Heretofore, however, techniques for forming surface contours on such cushions made by high volume production techniques have generally been restricted to sewing patterns in or quilting the cover assembly, or applying ties between the front and back surface of the cushion with buttons on their ends, both of which techniques add significantly to the time required to manufacture the cushions and thus increase their costs.

While cushions used in the automobile industry have utilized fastener portions with projecting hooked heads attached to the surface of a contoured foam pad which engage loops on the back of a relatively stiff and thick enclosure assembly that surrounds the pad to keep the enclosure assembly in place and in conformance with the surface contours of the pad, these fastener portions are considered too stiff to be used on the front surface of most pads used in household furniture, and thus this approach has not found wide usage outside of the automobile industry.

DISCLOSURE OF THE INVENTION

The present invention provides a method for making cushions of the type used on various types of furniture or as pillows that significantly broadens the ability of a designer to incorporate decorative and functional surface contours in the cushion.

According to the present invention there is provided a cushion comprising a resiliently compressible pad (e.g., foam rubber or urethane foam) having a major front surface, at least one opening extending at about a right angle to and opening through the front surface, an enclosure assembly surrounding and compressing the pad and comprising a flexible front cover overlaying the front surface of the pad and having a part extending into the opening, and engaged fastener means for retaining the part of the front cover in the opening including one fastener portion attached within the opening in a position spaced from the front surface of the pad, and another fastener portion attached to the part of the cover in the opening. One of the fastener portions can include a backing, stems projecting from the backing, and heads at the ends of the stems opposite the backing (e.g., preferably a fastener portion having heads with hook like parts projecting along the stems toward the backing made in accordance with the teachings in U.S. Pat. No. 4,454,183 incorporated herein by reference such as Scotchmate TM brand Treble Lock SJ-3446 available from Minnesota Mining and Manufacturing Company, St. Paul, Minn.); and the other fastener portion can have a backing and a multiplicity of projecting loops engaged around the heads of the first fastener portion (e.g., the Scotchmate TM brand woven nylon loop No. SJ-3401 available from Minnesota Mining and Manufacturing Company, St. Paul, Minn.).

Also, the present invention provides a novel method for forming such a cushion comprising (1) providing the flexible pad with its opening, the enclosure assembly and the fastener portions; (2) attaching one fastener portion to the inner surface of a part of the cover that will overlay the opening when the pad is received in the enclosure assembly; (3) attaching the other fastener portion within the opening and spaced from the front surface; and (4) pressing the part of the cover to which the second fastener portion is fastened into the opening in the pad to compress the cushion and engage the fastener portions.

In some embodiments of the cushion according to the present invention the fastener portion within the opening can be attached to the pad or the cover assembly with its backing at a right angle with respect to the front surface of the pad which places forces tending to separate the fastener portions parallel to their backings and provides extremely high holding forces. In other embodiments the fastener portion within the opening is attached to the enclosure assembly with the backing of that fastener portion generally parallel to the front surface of the pad, which can also provide adequate holding power between the fastener portions, and affords some very decorative effects.

Also, the opening can be elongate and either linear or arcuate with the first and second fastener portions extending along essentially the entire length of the opening; or the pad can have or define a plurality of through openings, and the cover can have a plurality of parts extending into the through openings with the cushion comprising separate fastening means for retaining the parts of the cover in each of the openings.

With the cushion structure described above the depth of the opening measured from the front surface of the uncompressed pad can be two, four, or even over twelve inches deep without interferring with easy assembly of the cushion.

Thus the cushion structure and method of assembly according to the present invention afford far greater varieties of cushion design for furniture or pillows produced by high volume production techniques than has been practical with prior cushion structures and assembly methods.

BRIEF DESCRIPTION OF THE DRAWING

The present invention will be further described with reference to the accompanying drawing where like reference numerals refer to like parts in the several views, and wherein.

DETAILED DESCRIPTION

Figure 1:
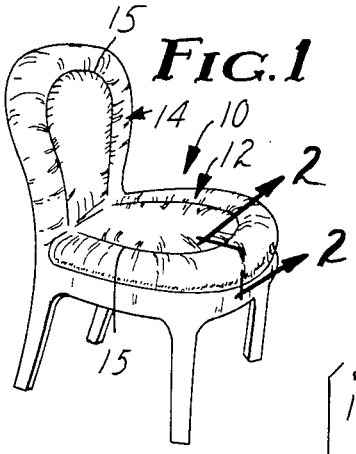
FIG. 1 is a perspective view of a chair incorporating a first embodiment of a cushion made according to the present invention.
Figure 2:
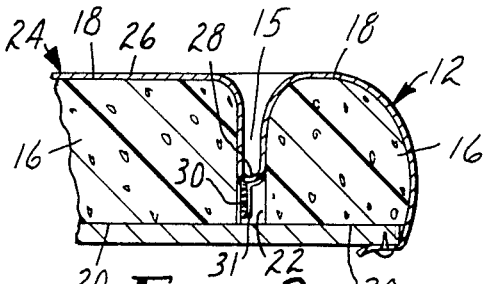
FIG. 2 is an enlarged fragmentary sectional view taken approximately along line 2—2 of FIG. 1.

Referring now to FIGS. 1 and 2, there is illustrated a chair 10 incorporating similar seat and back cushions 12 and 14 having arcuate channeling 15 on their surfaces that illustrate a first embodiment of a cushion according to the present invention.

As is best seen in FIG. 2 which shows an enlarged section of the seat cushion 12, the cushion 12 comprises a resiliently compressible pad 16 having major front and back surfaces 18 and 20, a through opening 22 in the form of an elongate arcuate slot extending at about a right angle between those surfaces 18 and 20, an enclosure assembly 24 surrounding the pad 16 and comprising a back cover 25 in the form of a wooden sheet 25 and a strong flexible cloth front cover 26 overlaying the front surface 18 of the pad 16 and having a part 28 extending into the through opening 22, and fastener means for retaining the part 28 of the front cover 26 in the through opening 22. The fastener means comprises a first fastener portion 30 including a backing, stems projecting from the backing, and heads at the ends of the stems opposite the backing having hook like portions projecting along the stems toward the backing (e.g., the Scotchmate TM brand Treble Lock SJ-3446), and a second fastener portion 31 having a backing with front and back surfaces and a multiplicity of loops projecting from the front surface engaged around the hook like portions of the first fastener portion 30 (e.g., the Scotchmate TM brand woven nylon loop No. SJ-3401). The first fastener portion 30 is attached by an adhesive to the pad 16 adjacent the junction between the through opening 22 and the back surface 20 of the pad 16 with its backing disposed generally at a right angle with respect to the front and back surfaces 18 and 20, whereas the second fastener portion 31 is attached by being sewn along one edge to the part 28 of the front cover 26 in the through opening 22 so that its backing is also disposed at a right angle with respect to the front and back surfaces 18 and 20 of the pad 16, thereby causing the forces that tend to separate the fastener portions 30 and 31 to be applied generally parallel to their backings which affords extremely firm engagement between the fastener portions 30 and 31.

Figure 3:
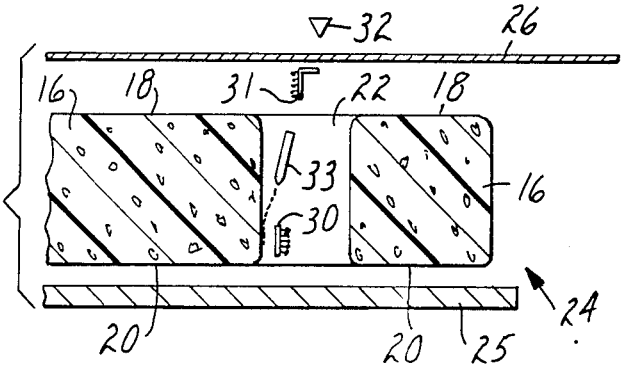
FIGS. 3 and 4 are fragmentary sectional views that illustrate the method for assembling the cushion shown in FIGS. 1 and 2.
Figure 4:
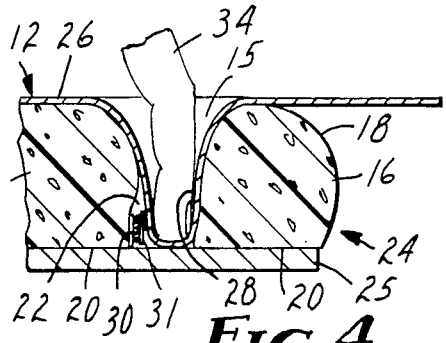

The method according to the present invention by which a person can assemble the cushions 12 and 14 is illustrated in FIGS. 3 and 4. As is seen in FIG. 3. The pad 16 with its through opening 22 is provided, as by cutting a block of urethane foam with an appropriate saw or knife, together with the other parts of the cushion 12 described above. The second fastener portion 31 is attached by being sewn by a sewing machine 32 along one longitudinal edge to the part 28 of the inner surface of the front cover 26 that will project into the opening 22 when the cushion 12 is assembled. The first fastener portion 30 is attached by an appropriate adhesive 33 to the pad 16 at a position adjacent the junction between the through opening 22 and the back surface 20 of the pad 16, and preferably has an open needled layer on its side opposite its projecting head that receives the adhesive to insure firm bonding to the pad 16. The person then adheres the pad 16 to the back cover 25 in an appropriate position, places the front cover 26 over the pad 16 and, as illustrated in FIG. 4, uses his hand 34 to press the part 28 of the front cover 26 to which the second fastener portion 31 is fastened into the through opening 22 in the pad 16 to engage the fastener portions 30 and 31 along their entire length, which requires moving his hand 34 along the full length of the opening 22. He then attaches the periphery of the front cover 26 to the periphery of the back cover 25 as by tacking the edges of the front cover 26 thereto in a conventional manner to slightly compress the pad 16, and the cushion 12 is completed.

Figure 5:
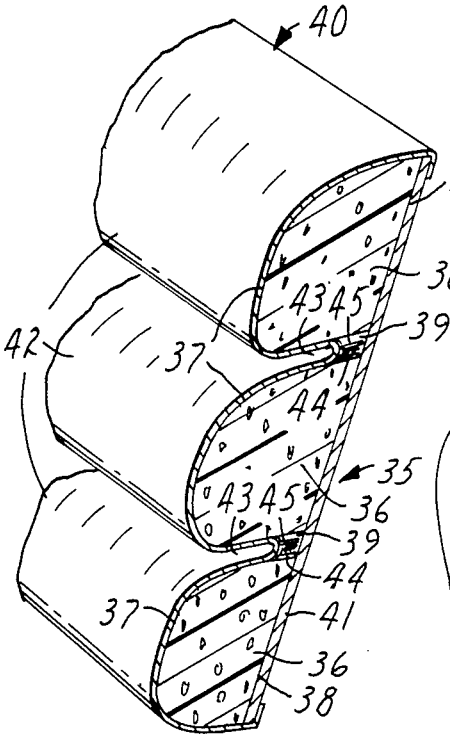
FIG. 5 is a sectional fragmentary perspective view of a second embodiment of a cushion made according to the present invention.

A second embodiment 35 of the cushion according to the present invention illustrated in FIG. 5 that provides parallel rows of linear channeling can also be made by a method similar to that described above to produce the cushions 12 and 14. The cushion 35 comprises a resiliently compressible pad 36 having major front and back surfaces 37 and 38, openings 39 in the form of two elongate linear slots extending at about a right angle between those surfaces 37 and 38, an enclosure assembly 40 surrounding the pad 36 and comprising a rigid (e.g., wooden) back cover 41 and a flexible coth front cover 42 overlaying the front surface 37 of the pad 36 and having parts 43 extending into the openings 39, and fastener means for retaining the parts 43 of the front cover 42 in the openings 39 comprising first and second fastener portions 44 and 45 identical to the fastening portions 30 and 31 in the cushion 12, and attached in the same way. The parts of the pad 36 defining the openings 39 are of differing heights as illustrated, however they may be of the same height if desired.

Figure 6:
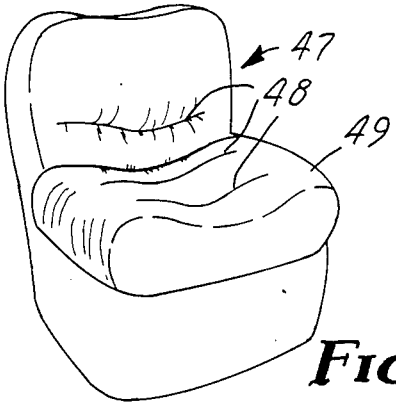
FIG. 6 is a perspective view of a chair incorporating a third embodiment of a cushion made according to the present invention.

FIG. 6 illustrates a chair 47 incorporating cushions made in a manner similar to that described above to provide the channeling 48. The channeling provided in the chair 47 is not only decorative, but also holds its outer cover 49 along the concave outer surface of its seat and back pads.

Figure 7:
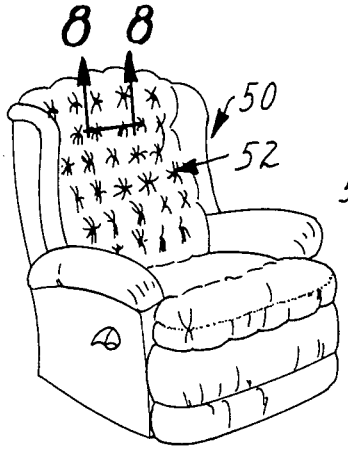
FIG. 7 is a perspective view of a chair incorporating a fourth embodiment of a cushion made according to the present invention.
Figure 8:
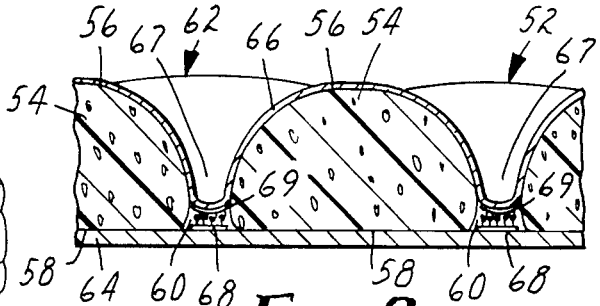
FIG. 8 is an enlarged fragmentary view taken approximately along line 8—8 of FIG. 7.

Referring now to FIGS. 7 and 8, there is illustrated a chair 50 incorporating a back cushion 52 illustrating a third embodiment of a cushion according to the present invention which has buttonless tufting along its surface. As is best seen in FIG. 8, the cushion 52 comprises a resiliently compressible pad 54 having major front and back surfaces 56 and 58, a plurality of through cylindrical regularly spaced openings 60 extending at about a right angle between those surfaces 56 and 58, an enclosure assembly 62 surrounding the pad 54 and comprising a back cover 64 in the form of a wooden sheet and a strong flexible cloth or leather front cover 66 overlaying the front surface 56 of the pad 54 and having a plurality of parts 67 extending into the through openings 60, and fastener means for retaining the parts 67 of the front cover 66 in the through openings 60. The fastener means comprises a first fastener portion 68 including a backing, stems projecting from the backing, and heads at the ends of the stems opposite the backing having hook like portions projecting along the stems toward the backing (e.g., the Scotchmate TM brand Treble Lock SJ-3446), and a second fastener portion 69 having a backing with front and back surfaces and a multiplicity of loops projecting from the front surface engaged around the hook like portions of the first fastener portion 30 (e.g., the Scotchmate TM brand woven nylon loop No. SJ-3401). The first fastener portions 68 are attached as by staples or adhesive to the back cover 64 adjacent the junctions between the through openings 60 and the back surface 58 of the pad 54 with the backings of the fastener portion 68 disposed generally parallel to the front and back surfaces 56 and 58, whereas the second fastener portions 69 are attached by being sewn along their centerlines to the parts 67 of the front cover 66 in the through openings 60 so that the backings of the second fastener portion 69 are also disposed generally at a right angle with respect to the front and back surfaces 56 and 58 of the pad 54, thereby causing the forces that tend to separate the fastener portions 68 and 69 to be applied generally at right angles to their backings, but allowing the second fastener portions 69 to bend around their lines of attachment and place in shear some of the engagement between the fastener portions 68 and 69.

Figure 9:
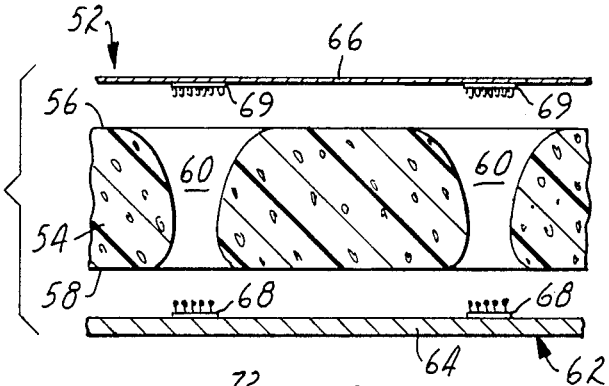
FIGS. 9 and 10 are fragmentary sectional views that illustrate the method according to the present invention for making the cushion shown in FIGS. 7 and 8.
Figure 10:
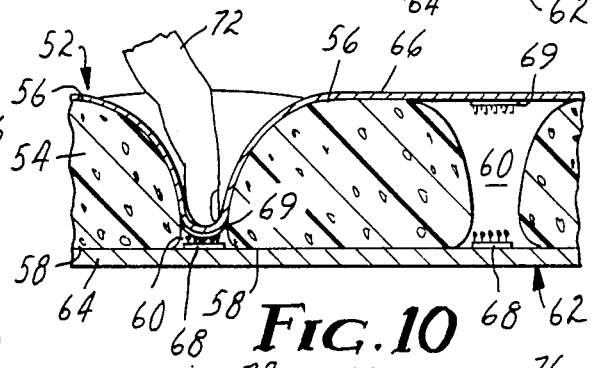

The method according to the present invention by which a person can assemble the cushion 52 is illustrated in FIGS. 9 and 10. As is seen schematically in FIG. 9, the second fastener portions 69 are attached by being sewn by a sewing machine along their centerliner to the parts 67 of the inner surface of the front cover 66 that will be positioned in the openings 60 when the cushion 52 is assembled, and the other fastener portion 68 is attached by tacks or an appropriate adhesive to the back cover 64 at positions adjacent the junctions between the through openings 60 and the back surface 58 of the pad 54 for the assembled cushion 52. The person then places the pad 54 on the back cover 64, positions the front cover 66 over the pad 54 and then, as illustrated in FIG. 9, uses his finger 72 to press the parts 67 of the front cover 66 to which the second fastener portions 69 are fastened into the through openings 60 in the pad 54 to engage the fastener portions 68 and 69. After the fastener portions 68 and 69 are all engaged the periphery of the front cover 66 is attached to the periphery of the back cover 64 as by tacking in a conventional manner after slightly compressing the pad 54 between the covers 66 and 64. As will be appreciated, this assembly technique lends itself well to automation, so thus may be particularly useful in the automotive trade.

Figure 11:
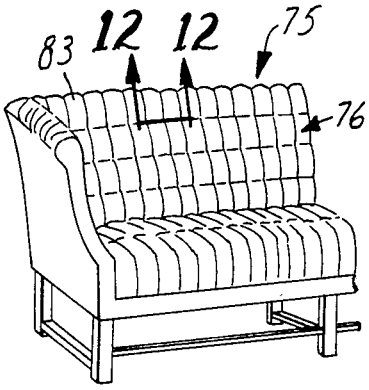
FIG. 11 is a fragmentary perspective view of a davenport incorporating a fifth embodiment of a cushion made according to the present invention.
Figure 12:
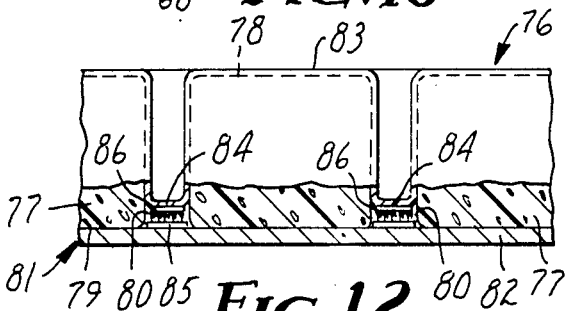
FIG. 12 is an enlarged fragmentary sectional view taken approximately along line 12—12 of FIG. 11.

Referring now to FIGS. 11 and 12, there is illustrated part of a davenport 75 incorporating a back cushion 76 illustrating a fourth embodiment of a cushion according to the present invention which has biscuit tufting along its surface. As is best seen in FIG. 12, the cushion 76 comprises a resiliently compressible pad 77 formed from a plurality of rectangular foam blocks having major front and back surfaces 78 and 79, and defining a plurality of through regularly spaced openings 80 between their adjacent corner edges extending at about a right angle between those surfaces 78 and 79, an enclosure assembly 81 surrounding the pad 77 and comprising a back cover 82 in the form of a wooden sheet and a strong flexible leather or cloth front cover 83 overlaying the front surface 78 of the pad 77 and having a plurality of parts 84 extending into the through openings 80, and fastener means for retaining the parts 84 of the front cover 83 in the through openings 80. The fastener means comprises a first fastener portion 85 including a backing, stems projecting from the backing, and heads at the ends of the stems opposite the backing having hook like portions projecting along the stems toward the backing (e.g., the Scotchmate TM brand Treble Lock SJ-3446), and a second fastener portion 86 having a backing with front and back surfaces and a multiplicity of loops projecting from the front surface engaged around the hook like portions of the first fastener portion 30 (e.g., the Scotchmate TM brand woven nylon loop No. SJ-3401). The first fastener portions 85 are attached as by staples or adhesive to the back cover 82 adjacent the junctions between the through openings 80 and the back surface 78 of the pad 77 with their backing disposed generally parallel to the front and back surfaces 78 and 79, whereas the second fastener portions 86 are attached by being sewn along their centerliner to the parts 84 of the front cover 83 in the through openings 80 so that their backings are also disposed at about a right angle with respect to the front and back surfaces 78 and 79 of the pad 77, thereby causing the forces that tend to separate the fastener portions 85 and 86 to be applied generally at right angles to their backings, but allowing the second fastener portions 86 to bend along their liner of attachment and place in shear some of the engagement between the fastener portions 85 and 86.

As will be appreciated the method according to the present invention for assembling the cushion 76 is essentially the same as that described above for assembling the cushion 52 illustrated in FIGS. 9 and 10, except that during such assembly portions of the front cover 83 will be pulled into the slots between the adjacent rectangular foam blocks forming the pad 77 to form the biscuit tufting around those blocks.

Figure 13:
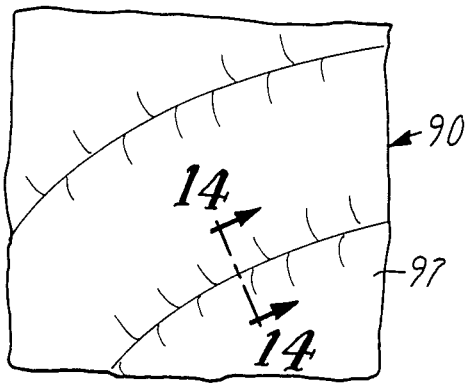
FIG. 13 is a perspective view of a sixth embodiment of a cushion made according to the present invention.
Figure 14:
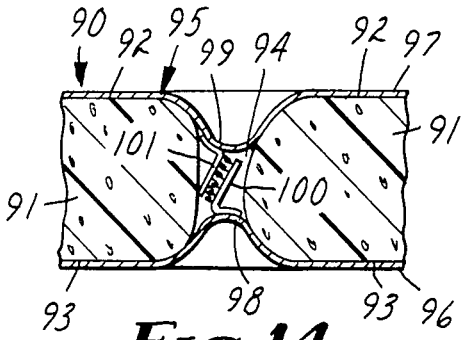
FIG. 14 is an enlarged fragmentary view taken approximately along line 14—14 of FIG. 13.

Referring now to FIGS. 13 and 14, there is shown a pillow 90 illustrating a fifth embodiment of a cushion according to the present invention having arcuate channeling along both of its major surfaces.

As is best seen in FIG. 14, the pillow 90 comprises a resiliently compressible pad 91 having major front and back surfaces 92 and 93, two through openings 94 in the form of elongate arcuate slots extending generally at right angles between those surfaces 92 and 93, an enclosure assembly 95 surrounding the pad 91 and comprising strong flexible cloth front and back covers 97 and 96 overlaying the front and rear surfaces 92 and 93 of the pad 91 respectively, both of which covers 96 and 97 have parts 98 and 99 respectively extending into the through openings 94, and fastener means for retaining the parts 98 and 99 in the through opening 94. The fastener means comprises a first fastener portion 100 including a backing, stems projecting from the backing, and heads at the ends of the stems opposite the backing having hook like portions projecting along the stems toward the backing (e.g., the Scotchmate TM brand Treble Lock SJ-3446), and a second fastener portion 101 having a backing with front and back surfaces and a multiplicity of loops projecting from the front surface engaged around the hook like portions of the first fastener portion 30 (e.g., the Scotchmate TM brand woven nylon loop No. SJ-3401). The first and second fastener portions 100 and 101 are attached to the back and front covers 97 and 96 respectively with their backings disposed generally at right angles with respect to the front and back surfaces 92 and 93 of the pad 91, by being sewn along one edge to the parts 98 and 99 of the covers 96 and 97 in the through openings 94 so that their backings are also disposed at right angles with respect to the front and back surfaces 92 and 93 of the pad 91, thereby causing the forces that tend to separate the fastener portions 100 and 101 to be applied generally parallel to their backings which affords extremely firm engagement therebetween.

Figure 15:
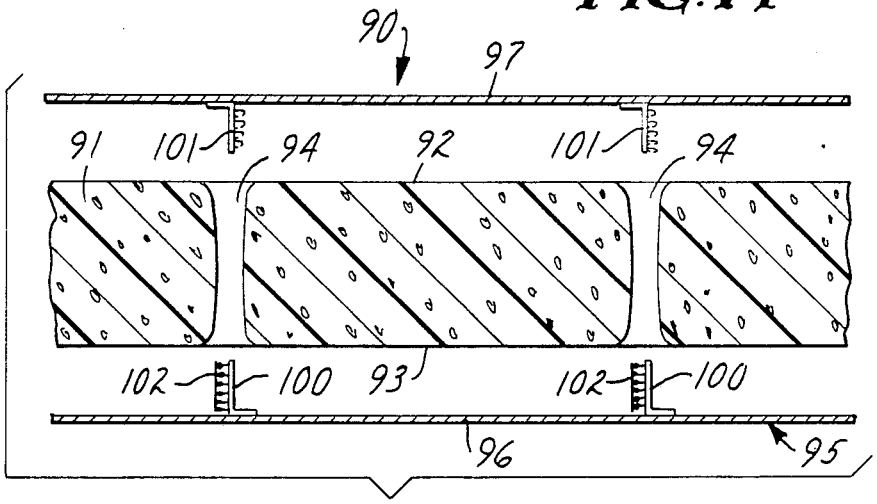
FIGS. 15 and 16 are fragmentary sectional views that illustrate the method according to the present invention for making the cushion shown in FIGS. 13 and 14.
Figure 16:
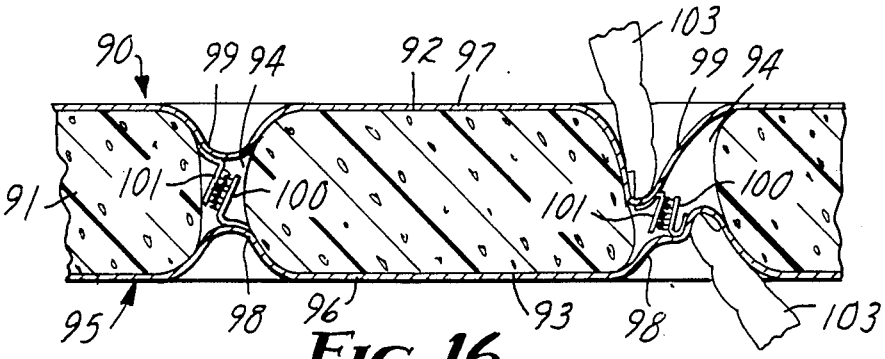

The method according to the present invention by which a person can assemble the pillow 90 is illustrated in FIGS. 15 and 16. As is seen schematically in FIG. 15, both fastener portions 100 and 101 are attached by being sewn by a sewing machine along one longitudinal edge to the parts 98 or 99 of the inner surface of the covers 96 or 97 that will overlay the openings 94 when the pillow 90 is assembled. The person then positions the pad 91 between the covers 96 and 97 which may be already partially sewn together around their peripheries in a conventional manner and then, as illustrated in FIG. 16, uses the fingers 103 of his two hands to press the parts 98 and 99 of the front covers 96 and 97 to which the fastener portions 100 and 101 are fastened into the through openings 94 in the pad 91 to engage the fastener portions 100 and 101 along their entire length which requires moving his hands along the full lengths of the openings 94. As illustrated in FIG. 15, the heads of the fastener portion 100 may be initially covered with a length of tape 102 to prevent premature engagement of the fastener, which tape is manually peeled away during attachment of the fastener portions 100 and 101. After the fastener portions 100 and 101 are engaged, the remaining unattached edges of the front and rear covers are attached together in a conventional manner as with stitching or a pre-attached zipper (not shown).

It will be appreciated that pillows similar to the pillow 90 that may have one or more straight or arcuate openings in their pad that extend for any length along the pillow, may be made by the method described above.

Having thus described the present invention with reference to numerous embodiments, it will be obvious to those skilled in the art that many modifications and/or combinations can be made of the structures and methods described herein without departing from the spirit of the present invention. It will be appreciated that the pad in the cushions may be of any material used for that purpose, and may be formed of two materials such as a layer of resiliently compressible material and an outer layer such as of dacron wrap that is sometimes used to help shape the outer cover. The outer cover may be of any conventional upholstery material such as cloth, vinyl, leather, etc. and the back cover may also be of such materials or of more rigid materials such as wood or plastic sheeting or strips. The fastener portions with the headed projections are preferably made in accordance with U.S. Pat. No. 4,454,183, which provides headed stems with hook like portions projecting along the stems that make very firm engagement with loop material. Such fasteners of the type indicated above which are about ⅝ inch wide have been found to provide adequate holding power when used in cushions, and at that width are not felt within cushions when they are set on. For some application headed fastener portions with mushroom shaped headed stems such as the Scotchmate TM brand woven mushroom fastener type SJ 3492 may also be adequate, however, particularly for low stress applications where the backings of the fastener portions are aligned at about right angles to the front and back faces of the cushions to place the engagement therebetween in shear. Thus the scope of the present invention should not be limited by the specific structure and method steps illustrated but only by those structure and method steps described by the dependent claims and their equivalents.

We claim:

1. A cushion comprising a resiliently compressible pad having major front and rear surfaces and at least one opening through and disposed at about a right angle to the front and rear surfaces, an enclosure assembly having an inner surface surrounding and comprssing the pad comprising a rear cover overlying the rear surface of the pad and a front cover overlaying the front surface of the pad and having a part extending into said opening, and fastener means for retaining said part of the front cover in the opening to compress the pad comprising a first fastener portion including a backing, stems projecting from the backing, and heads at the ends of the stems opposite the backing with hook like parts projecting along the stems toward said backing, and a second fastener portion having a backing with a front surface and a multiplicity of loops projecting from said front surface engaged around the hook like parts of said first fastener portion, one of said fastenfer portions being attached to a part of said rear cover at said opening and the other of said fastener portions being attached to the part of said front cover in said opening.

2. A cushion according to claim 1 wherein said fastener portion attached to said rear cover is positioned in said through opening with its backing generally at a right angle with respect to said front surface.

3. A cushion according to claim 1 wherein said fastener portion attached to said rear cover at said opening is positioned with the backing of the fastener portion generally parallel with respect to said front surface.

4. A cushion according to claim 1 wherein said opening is elongate and said first and second fastener portions extend along essentially the entire length of said opening.

5. A cushion according to claim 4 wherein said elongate opening is arcuate.

6. A cushion according to claim 1 wherein said pad has a plurality of openings, said cover has a plurality of parts extending into said openings and said cushion comprises fastening means for retaining the parts of said cover in said openings.

7. A cushion according to claim 1 wherein the depth of said opening from said front surface of the pad when normally expanded is over two inches.

8. A cushion according to claim 1 wherein the depth of said opening from said front surface of the pad when normally expanded is over four inches.

9. A cushion according to claim 1 wherein the depth of said opening from said front surface of the pad when normally expended is over twelve inches.

10. A cushion according to claim 1 wherein said rear cover is rigid and generally planar.

11. A cushion according to claim 1 wherein said second fastener portion is about ⅝ inch wide.

12. A cushion according to claim 1 wherein said rear cover is flexible and the part of said rear cover to which the fastener portion is attached extends into said opening.

13. A method for forming a cushion comprising:

providing a resiliently flexible pad having major front and rear surfaces and an opening through and disposed at about a right angle to the front and rear surfaces at a predetermined location; and an enclosure assembly having an inner surface adapted to surround the pad comprising a flexible front cover adapted to overlay the front surface of the pad and a back cover adapted to overlay the rear surface of the pad; a first fastener portion having a backing, stems projecting from the backing, and heads at the ends of the stems opposite the backing with hook like parts projecting along the stems toward the backing, and a second fastener portion having a backing with a front surface and a multiplicity of loops projecting from the front surface of the second fastener portion;

attaching one fastener portion to a part of the inner surface of the front cover that will be inserted in the opening when the cushion is assembled;

attaching the other fastener portion to a part of the back cover that will be positioned at the opening when the cushion is assembled;

positioning the enclosure assembly around the pad; and pressing the part of the cover to which the fastener portion is fastened into the opening in the pad to compress the pad and engage the fastener portions.

14. A method according to claim 13 wherein the opening and the first and second fastener portions are elongate and of about the same lengths, and said pressing step includes pressing the fastener portions together along their entire lengths.

* * * * *